United States Patent [19]

Askew

[11] Patent Number: 4,904,541

[45] Date of Patent: Feb. 27, 1990

[54] WIRE MESH FOR A VANDAL-PROOF SEAT

[75] Inventor: Terry Askew, Warners Bay, Australia

[73] Assignee: Hunter Wire Products Limited, New South Wales, Australia

[21] Appl. No.: 266,044

[22] Filed: Nov. 2, 1988

[30] Foreign Application Priority Data

Nov. 2, 1987 [AU] Australia ..... PI5191

[51] Int. Cl.[4] ..... B21F 27/02

[52] U.S. Cl. ..... 428/608; 5/448

[58] Field of Search ..... 428/605, 608, 247; 5/448; 245/5

[56] References Cited

U.S. PATENT DOCUMENTS

| | | | |
|---|---|---|---|
| 1,209,315 | 12/1916 | Malloy | 5/448 |
| 2,125,524 | 8/1938 | Smith | 428/247 |
| 3,161,258 | 12/1964 | Chapman | 245/5 |
| 3,647,608 | 3/1972 | Enlow | 428/319.1 |
| 3,906,560 | 9/1975 | Bulloch | 5/407 |
| 4,120,059 | 10/1978 | Cavaler | 5/478 |
| 4,190,914 | 3/1980 | Diallo | 5/476 |
| 4,423,103 | 12/1983 | Bogdany | 428/159 |
| 4,504,991 | 3/1985 | Klancnik | 5/483 |
| 4,673,613 | 6/1987 | Ward | 428/247 |
| 4,828,908 | 5/1989 | Park et al. | 428/247 |

FOREIGN PATENT DOCUMENTS

| | | | |
|---|---|---|---|
| 65316 | 11/1982 | European Pat. Off. | 5/448 |
| 61-229547 | 10/1986 | Japan | 428/247 |
| 16739 | of 1910 | United Kingdom | 5/448 |

*Primary Examiner*—John J. Zimmerman

*Attorney, Agent, or Firm*—Wegner & Bretschneider

[57] ABSTRACT

A mesh for incorporation in a seat cushion, the mesh having a plurality of wire lengths with each wire length being wound to follow a generally helical path so that each wire provides a plurality of convolutions, the mesh being provided with mesh parameters so as to inhibit penetration and cutting.

7 Claims, 2 Drawing Sheets

WIRE MESH FOR A VANDAL-PROOF SEAT

The present invention relates to vandal-proof seats and more particularly but not exclusively to vandal-proof seat cushions for seating used in public transport systems.

Currently available vandal-proof seats used in the public transport systems to inhibit impregnation and cutting employing a wire mesh. The mesh is of such a configuration that it is not satisfactorily comfortable and easy to form. Still further, this mesh does not lend itself for use in current seat design.

It is the object of the present invention to overcome or substantially ameliorate the above disadvantages.

There is disclosed herein a mesh for incorporation in a seat cushion, said mesh comprising a plurality of wire lengths with each wire length being wound to follow a generally helical path so that each wire provides a plurality of convolutions, with adjacent convolutions of adjacent wire lengths overlapping so as to be linked, and wherein each wire length is formed of medium carbon steel and having a diameter between 0.65 mm and 0.75 mm, with the mesh having pitched parameters as follows, distance A (as hereinafter defined) between 5.0 mm and 10.0 mm, distance B (as hereinafter defined) between 10.0 mm to 18.0 mm, and distance C (as hereinafter defined) between 7.0 mm and 12.0 mm.

Preferably the distance A is approximately 6.0 mm, the distance B 12.0 mm and the distance C 8.0 mm.

A preferred form of the present invention will now be described by way of example with reference to the accompanying drawings, wherein.

Figure 3:
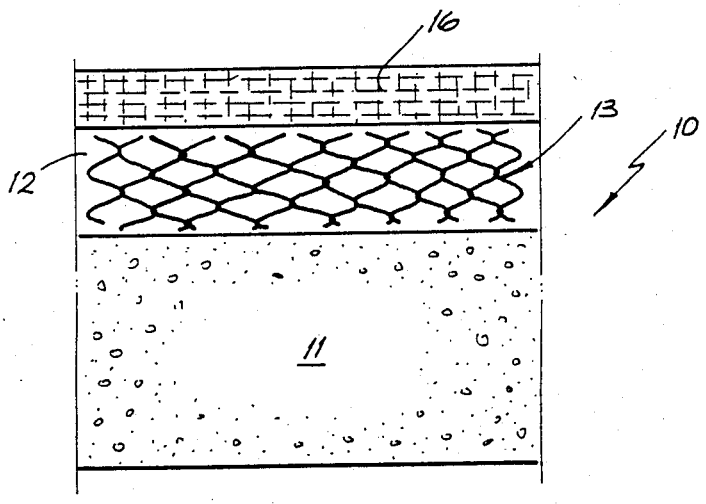
FIG. 3 is a schematic sectioned side elevation of a seat cushion employing the mesh of FIG. 1.

In FIG. 3 there is schematically depicted a portion 10 of a cushion. Preferably the cushion would be shaped to be received in a contoured seat base. The portion 10 includes a foam layer 11 shaped to fit the seat base and is formed of fire resistant foam. Laminated to the layer 11 is a further layer 12 of a silicon carbide compound reinforced with a mesh 13 more fully depicted in FIG. 1. Laminated to the layer 12 is a fabric 16.

The mesh 13 consists of a plurality of lengths of wire 14, with each wire being wound to provide a plurality of convolutions 15. The convolutions 15 of adjacent lengths 14 are interlinked so that the lengths of wire 14 are secured together to form a mesh 13. Preferably the lengths of wire 14 would be formed from a medium carbon, 1600/1850 MPA tensile steel. It is further preferred that the wire diameter be within the range of 0.65 mm to 0.75 mm and more preferably to be 0.71 mm.

Figure 1:
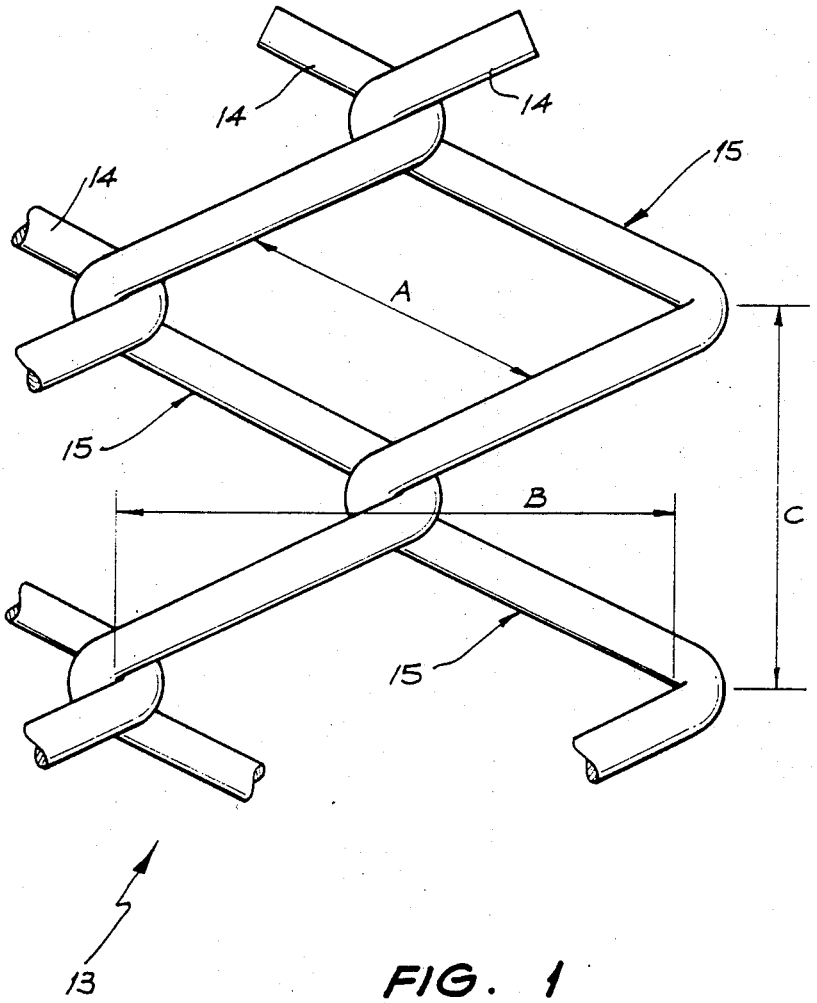
FIG. 1 is a schematic plan view of a portion of mesh to be employed in a seat cushion.
Figure 2:
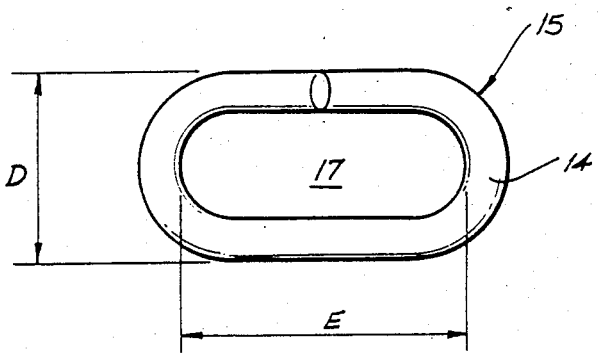
FIG. 2 is a schematic end elevation of one of the wire lengths employed in the mesh of FIG. 1.

The mesh 13 has mesh parameters A, B, C, D and E as seen in FIGS. 1 and 2. The distance A is the distance between parallel convolutions of adjacent lengths 14, and the distance B is the distance between apexes of adjacent convolutions. The distance C is the convolution pitch in each wire 14. The distance D is the convolution height, and the distance E is the maximum internal length of the cavity 17 devined by each convolution 15.

The distance A is preferably within the range of 5.0 mm to 10.0 mm, and more preferably is 6.0 mm. The distance B is preferably between 10.0 mm and 18.0 mm, and is preferably 12.0 mm. The distance C is preferably between 7.0 and 12.00 mm, and is preferably 8.0 mm. The distance D is preferably between 2.0 mm and 3.0 mm, and is more preferably to be approximately 2.5 mm. The distance E is preferably within the range of 5.0 mm to 6.0 mm, and most preferably is approximately 6.0 mm.

What I claim is:

1. A mesh for incorporation in a seat cushion, said mesh comprising a plurality of wire lengths with each wire length being wound to follow a generally helical path so that each wire provides a plurality of convolutions, with adjacent convolutions of adjacent wire lengths overlapping so as to be linked, and wherein each wire length is formed of medium carbon steel and having a diameter between 0.65 mm and 0.75 mm, and wherein the mesh has parameters A, B and C, and wherein the distance A is the distanct between parallel convolutions of adjacent wire lengths, and the distance B is the distance between apexes of adjacent convolutions, and the distance C is the convolution pitch in each wire, with the mesh having pitched parameters and wherein distance A is between 5.0 mm and 10.0 mm, distance B is between 10.0 mm to 18.0 mm, and distance C is between 7.0 mm and 12.0 mm.

2. The mesh of claim 1 wherein the distance A is approximately 6 mm, the distance B approximately 12 mm, and the distance C approximately 8 mm.

3. The mesh of claim 1 or 2 wherein the wire is formed from medium carbon, 1600/1850 MPA tensile steel.

4. The mesh of claim 3 wherein said wire has a diameter of between 0.65 mm and 0.75 mm.

5. The mesh of claim 4 wherein said wire has a diameter of 0.71 mm.

6. The mesh of claim 1 wherein the mesh has two further parameters including a distance D which is the convolution height and a distance E which is the maximum internal length of the cavity defined by each convolution, with the distance D being within the range of 2 mm to 3 mm, and the distance E within the range of 5 mm to 6 mm.

7. The mesh of claim 6 wherein the distance E is approximately 2.5 mm and the distance D approximately 6 mm.

* * * * *